US008156667B2

(12) United States Patent
Liu

(10) Patent No.: US 8,156,667 B2
(45) Date of Patent: Apr. 17, 2012

(54) STEAM IRON

(75) Inventor: Quanxi Liu, Fujian (CN)

(73) Assignee: Tsann Kuen (China) Enterprise Co., Ltd., Xiamen, Fujian (CN)

( * ) Notice: Subject to any disclaimer, the term of this patent is extended or adjusted under 35 U.S.C. 154(b) by 854 days.

(21) Appl. No.: 12/238,660

(22) Filed: Sep. 26, 2008

(65) Prior Publication Data

US 2009/0084007 A1 Apr. 2, 2009

(30) Foreign Application Priority Data

Sep. 29, 2007 (CN) ..... 2007 2 008406 U

(51) Int. Cl.
*D06F 75/18* (2006.01)
*D06F 75/26* (2006.01)

(52) U.S. Cl. ..... 38/77.7; 38/77.83

(58) Field of Classification Search ..... 38/74–77.9, 38/88; 219/246–248, 250, 256, 259
See application file for complete search history.

(56) References Cited

U.S. PATENT DOCUMENTS

| | | | | |
|---|---|---|---|---|
| 5,042,179 | A * | 8/1991 | van der Meer | 38/77.83 |
| 5,189,726 | A * | 2/1993 | Pan | 392/401 |
| 5,341,585 | A * | 8/1994 | Stephan et al. | 38/77.5 |
| 6,438,876 | B2 * | 8/2002 | Har et al. | 38/77.7 |
| 7,908,776 | B2 * | 3/2011 | Ng et al. | 38/77.6 |
| 2005/0278986 | A1 * | 12/2005 | Almanzar et al. | 38/77.1 |
| 2009/0151206 | A1 * | 6/2009 | Cai et al. | 38/1 C |

* cited by examiner

*Primary Examiner* — Ismael Izaguirre
(74) *Attorney, Agent, or Firm* — Kening Li; Pinsent Masons LLP

(57) ABSTRACT

The present invention discloses a steam iron, which comprises a base, a main body and a control board. The base comprises a water tank, a steam generator and a pump that is connected between the water tank and the steam generator. The main body comprises a controlling switch and an adjusting device for users controlling the steam iron. The control board is used to control the power of the pump to adjust the quantity of water that is pumped into the steam generator from the water tank and the quantity of steam generated by the steam generator. The control board is divided into at least two parts: a first part is connected to the controlling switch and the adjusting device and a second part is connected to the pump, and there is a signal line between the two parts.

10 Claims, 2 Drawing Sheets

STEAM IRON

FIELD OF THE INVENTION

Traditional irons with large amounts of steam usually gasify the water entirely in the boiler and carry the steam to the iron by a steam tube and eject the steam. Although this iron can produce a large amount of steam, it has the following shortcomings: first, when the water in the boiler is used up, the user can only open the boiler and add water into it until the pressure of the boiler falls, which is very inconvenient; second, the boiler must be able to support a high pressure, which results in high costs to manufacture the boiler; third, as a result of the high pressure in the boiler, the steam flux adjusting valve and the electromagnetic valve must be able to support a high pressure, with the result that these components have high cost; fourth, as a result of the high pressure in the boiler, it can likely cause the danger of an explosion.

Aiming at the above shortcomings, people give projects as follows: costly boiler is replaced by a closed electrothermal tray with a low compression resistance as a steam generator; the water in the tank is pumped into the steam generator by a pump; in the circumstances of controlling the pump's power well, the water that is pumped into the steam generator fully vapors and is carried to the steam outlet of the electrothermal tray by a steam tube, which can reach near to or even momentarily exceed quantity of steam of traditional boiler iron. This solution has the following advantages: firstly, the steam generator has a lower pressure, is safer than the boiler and has a low cost; secondly, the quantity of steam is adjusted easily only by a control board driving the pump for controlling the pump's power, which can directly controls the quantity of water that is pumped into the steam generator; thirdly, because the tank has no pressure problem, the water is added into the tank expediently with no waiting for the pressure relief of the boiler.

For controlling the iron not dripping in spraying steam the temperature of the steam generator must be detected. If the temperature is too low, the water must not be pumped; because the empty pumping of the pump will seriously affect its life, so the quantity of water in the tank must be detected, and the quantity of water is too little to be pumped for avoiding empty pumping. To meet the above needs there will be at least two signals that must be detected and dealt with and a controlling signal of the pump in the base of the iron. There will be at least two controlling signals that must be detected and dealt with for at least two levels of adjusting device of the quantity of steam in the main body of the iron. Whatever the control board of the pump is placed on the main body or the base of the iron, there will be 3 to 4 signal lines in the power line of steam tube for connecting the main body to the base. Conventional power line of steam tube usually has four lines: L, N, GND and a signal line. So there will be 2 to 3 more lines than conventional power line of steam tube. Because the power line of steam tube refers to safety norms and commonality, the cost will increase sharply. At the same time the increasing of lines of the power line of steam tube will make that the design of the elbow and other structure of the iron difficult, and there will be more working procedures for connecting terminals to connect these signal lines.

SUMMARY OF THE INVENTION

The present invention provides a steam iron, which overcomes the shortcomings of known irons.

The present invention adopts technical solutions to overcome the shortcomings as follows.

A steam iron comprises a base, a main body and a control board. The base comprises a water tank, a steam generator and a pump that is connected between the water tank and the steam generator. The main body comprises a controlling switch and an adjusting device for users controlling the steam iron. The control board is used to control the power of the pump to adjust the quantity of water that is pumped into the steam generator from the water tank and the quantity of steam generated by the steam generator. The control board is divided into at least two parts: a first part that is connected to the controlling switch and the adjusting device and a second part that is connected to the pump and there is signal line between the two parts.

According to a preferred embodiment of the present technical scheme, the steam generator has a temperature information collector, and the water tank has a water level signal collector; the control board is divided into two parts, wherein a first part is a level signal collecting board that is used to collect the signal of the quantity of steam that is set by the adjusting device and the signal that is set by the controlling switch and to change the signals to specifically pulse signals or different voltage signals;

a second part is a pump control board that is connected to the temperature information collector and the water level signal collector and is used to integrate and to synthesize the level signal that is collected by the level signal collecting board and the temperature information of the temperature information collector and the water level signal of the water lever signal collector, and to give an order to control the action of the pump.

According to a preferred embodiment of the present invention, the first part is set in the main body and the second part is set in the main body.

According to a preferred embodiment of the present invention, the number of signal line between the first part and the second part is one.

According to a preferred embodiment of the present invention, the steam iron of the present invention also comprises a first indicator that is used to show the temperature information of the temperature information collector and is connected to the level signal collecting board.

According to a preferred embodiment of the present invention, the steam iron also comprises a second indicator that is connected to the level signal collecting board and is used to show the water level signal of the water level signal collector.

According to a preferred embodiment of the present invention, the steam iron also comprises a power line for supplying power that is connected between the base and the main body, and the signal line is set in the power line.

The present invention adopts another technical solution to overcome the shortcomings as follows.

A steam iron comprises a base, a main body and a control board. The base comprises a water tank, a steam generator and a pump that is connected between the water tank and the steam generator; the steam generator has a normally closed thermostat for measuring the temperature of the steam generator; the water tank has a water level monitoring switch for monitoring whether the tank is in water shortage. The main body comprises a controlling switch and an adjusting device for users controlling the steam iron. The control board is used to controlling the power of the pump to adjust the quantity of water that is pumped into the steam generator from the water tank and the quantity of steam generated by the steam generator. The control board comprises a pump controlling circuit and a level signal collecting circuit; the pump controlling circuit is connected to the level signal collecting circuit; the pump controlling circuit is connected to the normally closed thermostat and the water level monitoring switch; the level signal collecting circuit is connected to the controlling switch and the adjusting device; there is signal line for connecting the controlling circuit to the pump.

According to a preferred embodiment of the present invention, the control board is set in the main body.

According to a preferred embodiment of the present invention, the steam iron of the present invention also comprises a power line for supplying power that is connected between the base and the main body, and the signal line is set in the power line.

In the steam iron of the present invention the control board is divided into two parts, in which the first part is used to deal with signals of controlling switches and the adjustment device and the second part is used to deal with signals of the water tank and the steam generator and the signals from the first part synthetically and gives an order to control the action of the pump. So there are less signal transmission between the base and the main body of the iron, which overcomes the shortcomings of known irons. Because a normally closed thermostat is used for measuring the temperature of the steam generator and a water level monitoring switch is used for monitoring whether the water tank is in water shortage, and these two components are in the series circuit in the power or control loop of the pump, so it can assure that the iron will not drip in spraying steam with no more signal line for transmitting the signal and can assure that there will be no empty pumping for the pump, which makes that there are less signal lines between the base and the main body of the iron, which overcomes the shortcomings of known irons.

BRIEF DESCRIPTION OF THE DRAWINGS

The present invention will be further described according to the drawings and embodiments.

DETAILED DESCRIPTION OF THE INVENTION

Figure 1:
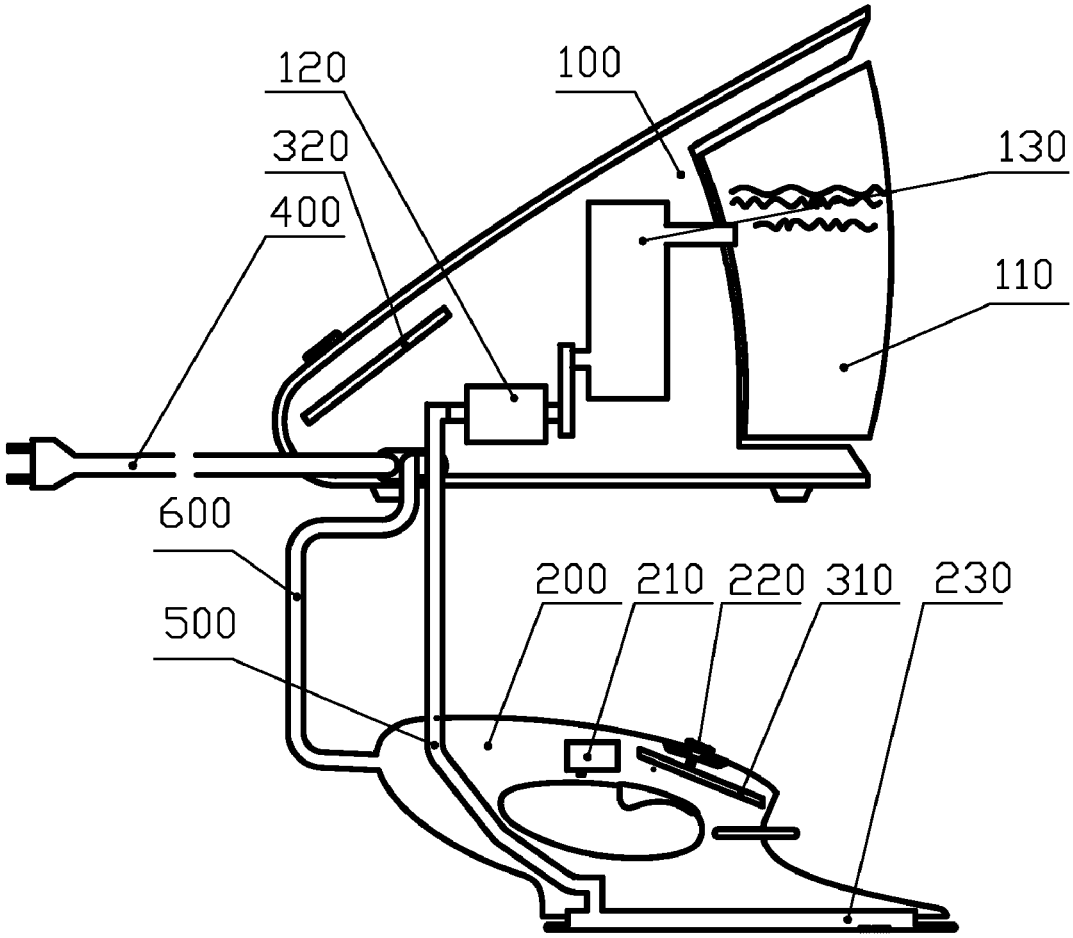
FIG. 1 is a sketch map of the steam iron of a preferred embodiment of the present invention.

Referring to FIG. 1, it is a sketch map of a steam iron according to a preferred embodiment of the present invention. The steam iron comprises a base 100, a main body 200, a control board and an electric plug 400 with electric cord that supplies power for the steam iron and can be inserted into the outside electric socket.

The base 100 comprises a water tank 110, a steam generator 120 and a pump 130 that is connected between the water tank 110 and the steam generator 120. The steam generator 120 has a temperature information collector. The water tank 110 has a water level signal collector.

The main body 200 has a controlling switch 210 and an adjusting device 220 for users controlling the steam iron. The main body 200 also has a steam jetting mouth 230 of electric heating dish. A steam tube 500 is set between the base 100 and the main body 200. The steam tube 500 is connected to the steam generator 120 and the steam jetting mouth 230 of electric heating dish.

The control board is used to controlling the power of the pump 130 to adjust the quantity of water that is pumped into the steam generator 120 from the water tank 110 and the quantity of steam generated by the steam generator 120. The control board is divided into at least two parts as follows:

A first part is a level signal collecting board 310 that is fixedly disposed in the main body 200 and is connected to the controlling switch 210 and the adjusting device 220. The level signal collecting board 310 is used to collect the signal of the quantity of steam that is set by the adjusting device 220 and the signal that is set by the controlling switch 210 and to change the signals to specifically pulse signals or different voltage signals to transmit to a pump control board 320.

A second part is the pump control board 320 that is disposed in the base 100 and is connected to the pump 130 and the temperature information collector and the water level signal collector. The pump control board 320 is used to integrate and to synthesize the level signal that collected by the level signal collecting board 310 and the temperature information of the temperature information collector and the water level signal of the water lever signal collector, and to give an order to control the action and the pump discharge of the pump 130.

Figure 2:
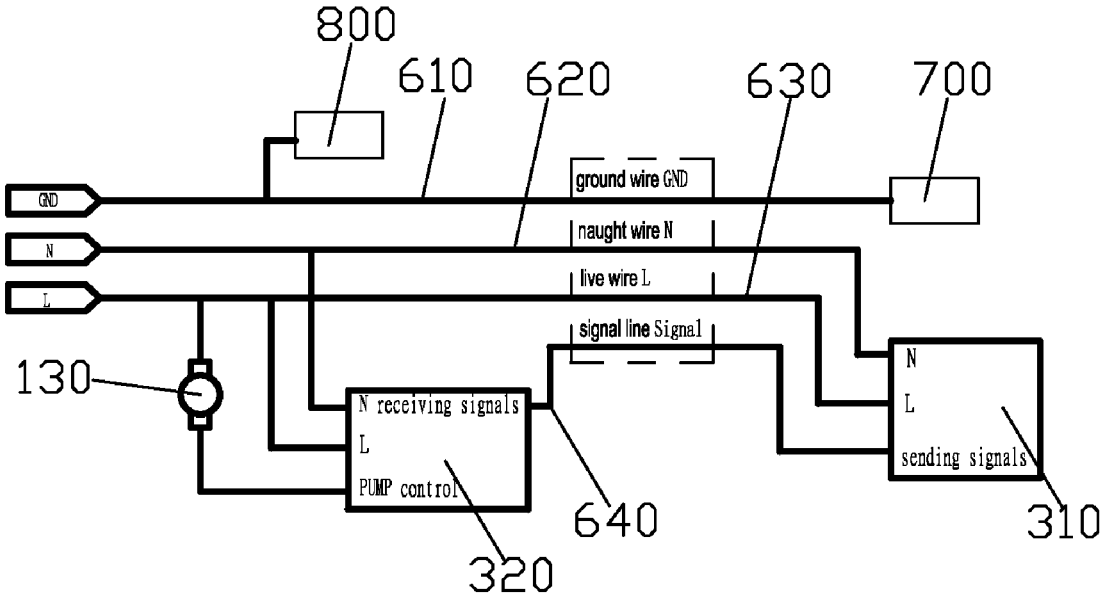
FIG. 2 is a sketch map of circuitry arrangement of the steam iron of a preferred embodiment of the present invention.

There is a power and signal cord 600 between the pump control board 320 of the base 100 and the level signal collecting board 310 of the main body 200. Referring to FIG. 2, it is a sketch map of the circuit layout of the present invention according to a preferred embodiment. The power and signal cord 600 comprises a ground wire 610, a naught wire 620, a live wire 630 and a signal line 640. One end of the ground wire 610 is connected to an electric hot tray 700 (externally connected to a power cord 400), and the other end is connected to a boiler shell 800 (the shell of the base 100). Both one end of the naught wire 620 and one end of the live wire 630 are connected to the power cord 400, and both the other end of the naught wire 620 and the other end of the live wire 630 are connected to the pump control board 320. One end of the signal line 640 is connected to level signal collecting board 310, and the other end is connected to the pump control board 320. One end of the pump 130 is connected to the live wire 630 and the other end is connected to the pump control board 320. The pump control board 320 controls whether the pump 130 is connected to the naught wire 620.

If needed, the steam iron also comprises a first indicator that is connected to the level signal collecting board and is used to show the temperature information of the temperature information collector, and a second indicator that is connected to the level signal collecting board and is used to show the water level signal of the water level signal collector. The first indicator and the second indicator show current states of the iron by LED or LCD, such as that the water tank 110 is lack of water, the steam generator 120 is in preheating, or the temperature of the steam generator 120 is too low to generate steam. Essential states of the iron can be shown on LCD or LED by improving known iron slightly. Its principle as follows: to make the pump control board 320 have the function of transmitting the temperature information of the steam generator 120 and the water level information of the water tank 110 to the level signal collecting board 310; to make the level signal collecting board 310 have the function of receiving and processing the information from the pump control board 320; to make the level signal collecting board 310 have display function. All the information transmission can be achieved by the one signal line.

If needed, the adjusting device 11 controlling the quantity of steam can be set on a handle of the main body 200. Users can adjust the quantity of the steam by adjusting the power of the pump 2 with one hand.

In another preferred embodiment, the steam generator has a normally closed thermostat for measuring the temperature of the steam generator; the tank has a water level monitoring switch for monitoring whether the water tank is in water shortage. The control board comprises a pump controlling circuit that is set on the base 100 and a level signal collecting circuit that is set on the main body 200. The pump controlling circuit is connected to the level signal collecting circuit. The pump controlling circuit is connected to the normally closed thermostat and the water level monitoring switch. Whether the pump controlling circuit is broke is decided by the monitoring condition of the normally closed thermostat and the water level monitoring switch. The level signal collecting circuit is connected to the controlling switch and the adjusting device, and there is a signal line for connecting the controlling circuit to the pump. Since these two components are in the series circuit in the power or control loop of the pump, and so just one signal line can be able to control the pump and can protect the iron out of dropping water and drawing water in lack of water. This scheme has the advantages of simple lines, lower cost. According to actual needs, the level signal collecting circuit (board) can be not placed on the iron, but is placed in power lines of steam tube, and it is convenient for users to adjust steam quantity without incremental cost.

The foregoing description of the exemplary embodiment of the invention has been presented for the purposes of illustration and description. It is not intended to be exhaustive or to limit the invention to the precise form disclosed. Many modifications and variations are possible in light of the above teaching. All changes that come within the meaning and range of equivalency of the claims are to be embraced within their scope.

What is claimed is:

1. A steam iron, comprising:

a base comprising a water tank, a steam generator and a pump that is connected between the water tank and the steam generator, wherein the steam generator has a temperature information collector;

a main body, comprising a controlling switch and an adjusting device for controlling the steam iron; and a control board which is used to control the power of the pump to adjust the quantity of water that is pumped into the steam generator from the water tank, and the quantity of steam generated by the steam generator, wherein the control board is divided into at least two parts: a first part that is connected to the controlling switch and the adjusting device, and a second part that is connected to the pump, and there is a signal line between the two parts.

2. The steam iron according to claim 1, wherein the water tank has a water level signal collector; and wherein the first part of the control board is a level signal collecting board that collects the signal of the quantity of steam that is set by the adjusting device and a signal that is set by the controlling switch and to convert the signals to specifically pulse signals or different voltage signals;

the second part of the control board is a pump control board that is connected to the temperature information collector and the water level signal collector, and is used to integrate and to synthesize the level signal that is collected by the level signal collecting board and the temperature information of the temperature information collector and the water level signal of the water lever signal collector, and to give an order to control the action of the pump.

3. The steam iron according to claim 2, wherein the first part is set in the main body and the second part is set in the main body.

4. The steam iron according to claim 3, wherein the number of the signal line between the first part and the second part is one.

5. The steam iron according to claim 4, further comprising a first indicator that is used to display the temperature information of the temperature information collector and is connected to the level signal collecting board.

6. The steam iron according to claim 4, further comprising a second indicator that is connected to the level signal collecting board and is used to show the water level signal of the water level signal collector.

7. The steam iron according to claim 1, further comprising a power line for supplying power that is connected between the base and the main body, and the signal line is set in the power line.

8. A steam iron, comprising a base comprising a water tank, a steam generator, and a pump that is connected between the water tank and the steam generator; the steam generator has a normally closed thermostat for measuring the temperature of the steam generator; the water tank has a water level monitoring switch for monitoring whether the tank lacks water;

a main body, comprising a controlling switch and an adjusting device for a user to control the steam iron; and a control board, which is used to control the power of the pump to adjust the quantity of water that is pumped into the steam generator from the water tank and the quantity of steam generated by the steam generator; wherein the control board comprises a pump controlling circuit and a level signal collecting circuit; the pump controlling circuit is connected to the level signal collecting circuit; the pump controlling circuit is connected to the normally closed thermostat and the water level monitoring switch; the level signal collecting circuit is connected to the controlling switch and the adjusting device; and there is signal line for connecting the controlling circuit to the pump.

9. The steam iron according to claim 8, wherein the control board is set in the main body.

10. The steam iron according to claim 8, further comprising a power line for supplying power, which that is connected between the base and the main body, and the signal line is set in the power line.

* * * * *